US005160029A

United States Patent [19]

Pigott et al.

[11] Patent Number: 5,160,029

[45] Date of Patent: Nov. 3, 1992

[54] UNITARY TOP FRAME

[75] Inventors: Maurice J. Pigott, Winnetka; Brandon L. Pigott; Peter S. Pigott, both of Wilmette; Schuyler F. Pigott, Arlington Heights, all of Ill.

[73] Assignee: Nucon Corporation, Northbrook, Ill.

[21] Appl. No.: 614,903

[22] Filed: Nov. 16, 1990

[51] Int. Cl.[5] ..... B65D 85/48

[52] U.S. Cl. ..... 206/453; 108/51.1; 206/586; 206/386

[58] Field of Search ..... 206/453, 586, 386, 593, 206/594, 597; 108/51.1, 54.1

[56] References Cited

U.S. PATENT DOCUMENTS

| | | | |
|---|---|---|---|
| 3,152,693 | 10/1964 | Anderson | 206/453 |
| 3,683,821 | 8/1972 | Mangold | 108/53 |
| 3,994,241 | 11/1976 | Evans | 108/53.5 |
| 4,002,126 | 1/1977 | Bell et al. | 206/386 X |
| 4,316,419 | 2/1982 | Cupido | 108/56.1 |
| 4,799,433 | 1/1989 | Luft | 108/51.1 |
| 4,869,456 | 9/1989 | Jacobs | 108/51.1 X |
| 4,951,821 | 8/1990 | Kempkes | 206/453 |
| 4,972,782 | 11/1990 | Shepherd et al. | 108/51.1 X |
| 4,998,619 | 3/1991 | Sowa et al. | 206/386 X |

FOREIGN PATENT DOCUMENTS

| | | | |
|---|---|---|---|
| 3806097 | 9/1989 | Fed. Rep. of Germany | 206/386 |
| 0701869 | 12/1979 | U.S.S.R. | 108/54.1 |
| 166485 | 1/1922 | United Kingdom | 206/453 |

*Primary Examiner*—Jimmy G. Foster
*Assistant Examiner*—BethAnne Cicconi
*Attorney, Agent, or Firm*—Wallenstein Wagner & Hattis, Ltd.

[57] ABSTRACT

A unitary top frame device adapted for use with palletized goods is disclosed that is light in weight, durable, reversible, easy to manufacture and has a minimum number of parts is disclosed. The frame (10) has a substantially flat first surface (11) and a second surface (12) with a reinforcement structure projecting outwardly therefrom and includes a pair of side members (13), a pair of end members (14), a first cross member (15) a second cross member (15). The reinforcement structure of each of the members (13,14,15,16) includes a plurality of longitudinal ribs (21) and transverse ribs (22). Interposed between each of the members (13,14,15,16) is reinforcement element, being either a center (31), corner (32) first intermediate (33) or a second intermediate (34) reinforcement element. Each side member (13) and each end member (14) further includes a strap slot (61) for receiving a strap member (S). The longitudinal rib (21) immediately adjacent the strap slot (61) has having an off-set portion and there is a double density of transverse ribs (22) integral with this off-set portion of said longitudinal rib (21).

25 Claims, 3 Drawing Sheets

UNITARY TOP FRAME

DESCRIPTION

1. Technical Field

The present invention relates to frames that are used in conjunction with pallets, and more particularly, to a unitary top frame device that is strapped in a position on top of the goods that are resting on the pallet. Goods being stored or transported can thus be secured between a pallet and the unitary top frame.

2. Background Prior Art

It is customary to transport goods and to store goods on pallets. Palletized goods are maintained in a position above the flooring which can be very advantageous in areas where there is flooding or where the condition of the flooring is either rough or of concern. Standard pallets are particularly useful in materials handling because forklift equipment can maneuver the pallets by inserting their forklift tines into openings provided by the pallet. Typically, pallets are constructed of wood. However, more frequently today, plastic pallets are being used. Highly successful plastic pallets that are light in weight, durable, capable of supporting heavy loads and are easy to manufacture and have a minimum number of parts that are interchangeable are disclosed in U.S. Pat. No. 4,843,976, issued Jul. 4, 1989, entitled PLASTIC PALLET and assigned to Nucon Corporation, Assignee of the present invention, and in PCT Patent Application No. PCT/US89/03314 filed Aug. 1, 1989, entitled PLASTIC PALLET WITH DECK ASSEMBLY and also assigned to Nucon Corporation.

Unfortunately, at times there is difficulty in maintaining the goods on a pallet. While the goods are being moved, they can slip or slide on the pallet and either move to a different location on the pallet deck or fall off the pallet. Such occurrences can cause damage not only to the palletized goods but also to the pallets, to the surrounding goods, to the surrounding equipment, such as the forklift truck and surrounding pallets, and to the housing facilities. Moreover, these occurrences can injure, even fatally, personnel in the immediate area.

While one solution is strapping the goods to the pallet, straps can slip because the goods are often irregularly shaped or are loose on the pallet, or the straps are not properly secured. For this reason, top frames are, at times, employed in conjunction with the pallet and the goods. The goods are placed on the pallet and a top frame is placed on the goods. The entire assembly is strapped together by encircling straps.

Significant drawbacks to using top frames are that they can be bulky and heavy and they can be structurally unsound. Thus, while a number of solutions have been proposed a need exists for a plastic top frame that is also light in weight, durable, easy to manufacture and transport and has a minimum number of parts.

SUMMARY OF THE INVENTION

According to the present invention, a plastic, unitary frame adapted for use with palletized goods has been developed that includes a pair of side members and a pair of end members that intersect and are connected to the side members. A first cross member and a second cross member are disposed between both the side members and the end members with the first cross member being connected to the side members and the second cross members being connected to the end members. The frame further includes a substantially flat first surface and a second surface with a reinforcement structure projecting outwardly therefrom. This frame is light in weight, durable, easy to manufacture and transport and has only five parts, being a frame and four pads. The frame can also be reversed, i.e., flipped over so that the top surface becomes the bottom surface and the bottom surface becomes the top surface, depending on the intended use of the frame or the characteristics of the palletized goods.

More specifically, according to one aspect of the present invention, the frame is a planar member that includes an integral rectangular perimeter support structure and an integral internal support structure. The rectangular perimeter support structure comprises a pair of substantially parallel side members and a pair of substantial parallel end members integral with and perpendicular to the side members. The internal support structure comprises a first cross member integral with and perpendicular to the end members and a second cross member integral with and perpendicular to the side members. Both cross members intersect each other substantially at the center.

According to a further aspect of the present invention, each end member, side member and cross member has a plurality of longitudinal ribs interconnected to a plurality of transverse ribs. Each of these ribs extends and projects outwardly from the second surface of the frame. Interposed between the reinforcement structures of the first cross member and the second cross member is a generally X-shaped integral center reinforcement element. This center reinforcement element has at each of the four ends an end rib that is also a transverse rib of one of the cross members.

Interposed between the reinforcement structures of each side member and each end member is a generally rectangular-shaped corner reinforcement element. This corner reinforcement element has at one side a first end rib that is also a transverse rib of a side member and at an adjacent side, a second end rib that is also a transverse rib of an end member.

Also, interposed between the reinforcement structures of the first cross member and each end member is a generally T-shaped first intermediate reinforcement element. Each first intermediate reinforcement element has at the first end, a first end rib that is also a transverse rib of one of the end members, at the second, opposite end, a second end rib that is also a separate transverse rib of the same end member and at the third, intermediate end, a third end rib that is also a transverse rib of the first cross member.

Similarly, interposed between the reinforcement structures of the second cross member and each side member is a generally T-shaped second intermediate reinforcement element. In much the same manner as the first intermediate reinforcement element, each second intermediate reinforcement element has at the first end, a first end rib that is also a transverse rib or one of the side members, at the second, opposite end, a second end rib that is also a separate transverse rib of the same side member and at the third, intermediate end, a third end rib that is also a transverse rib of the second cross member.

According to another aspect of the present invention, the center reinforcement element has a pair of angled ribs intersecting each other substantially in the middle and perpendicularly. Moreover, each corner reinforcement element has an angled rib extending outwardly from the innermost point to the outermost point of the element and a pair of first median ribs. Each first median rib bisect and is substantially perpendicular to one of the end ribs of the corner reinforcement element. This angled rib in the corner reinforcement element has interposed within it a supporting rib for holding a pad.

Consequently, there are four pads secured to the frame.

Additionally, each first and each second intermediate reinforcement element includes internal angled ribs that are a pair of outwardly-converging diagonal ribs that intersect a second median rib. The second median rib bisects and is substantially perpendicular to both the first and the second end ribs of the intermediate reinforcement element.

According to a still further aspect of the present frame, each side member and each end member includes a strap slot for receiving a strap. To compensate for this slot without loosing significant structural strength, the longitudinal rib immediately adjacent the strap slot is off-set so as to have an off-set portion. And, there is a densification of the transverse ribs integral with the off-set portion of the longitudinal rib. This densification is preferably two so that there is a double density, or two for one densification, of transverse ribs.

Other advantages and aspects of the present invention will become apparent upon reading the following description of the drawings and detailed description of the invention.

DETAILED DESCRIPTION

Figure 1:
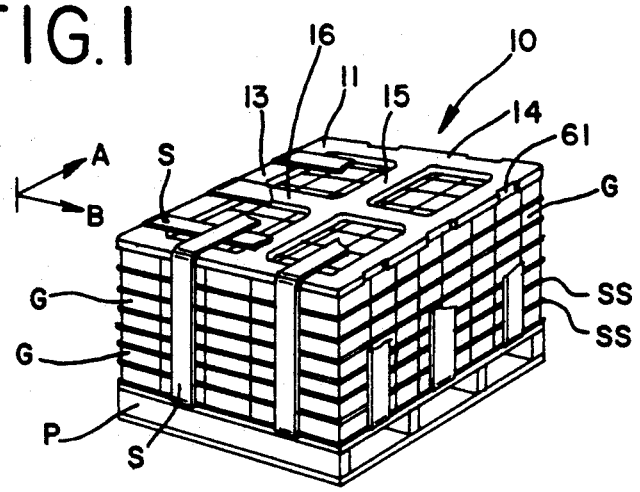
FIG. 1 is a perspective view of a pallet, supporting goods with the unitary top frame made in accordance with the teachings of the present invention.
Figure 2:
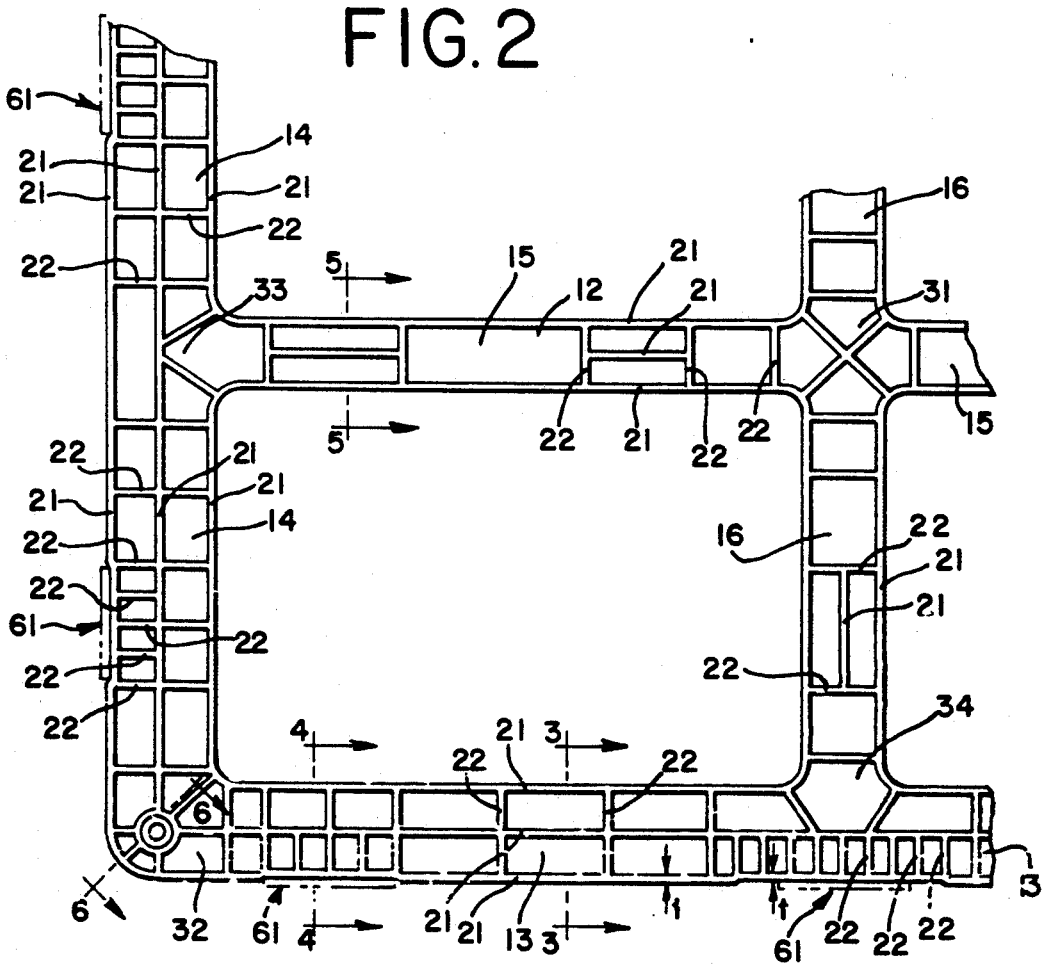
FIG. 2 is a bottom plan view of a portion of the unitary top frame made in accordance with the teachings of the present invention.
Figure 3:
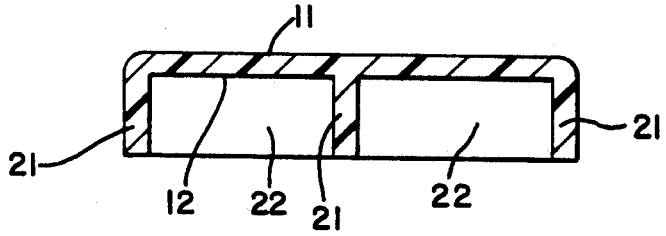
FIG. 3 is a cross-sectional view along line 3—3 of FIG. 2.
Figure 4:
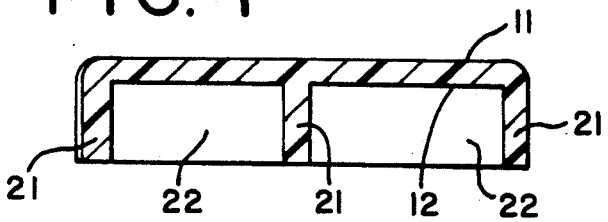
FIG. 4 is a cross-sectional view along line 4—4 of FIG. 2.
Figure 5:
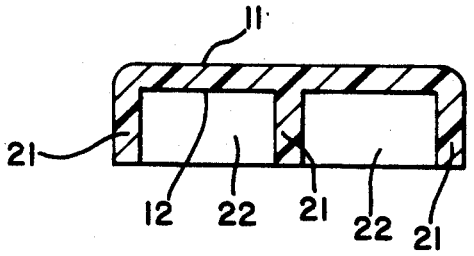
FIG. 5 is a cross-sectional view along line 5—5 of FIG. 2.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

As shown in FIG. 1 of the figures, the unitary frame, designated generally by the reference numeral 10, is used in conjunction with a pallet P and a plurality of straps S for holding a block of goods G. Often, palletized goods G are stacked in groups having a set number of rows with separator sheets SS in between the rows. As noted previously, suitable and highly successful pallets for supporting the cans, among other things, incorporated herein by reference, are disclosed in U.S. Pat. No. 4,843,976, and in PCT Patent Application No. PCT/US89/03314, both assigned to the Assignee and owner of the present invention, Nucon Corporation.

The frame 10 has both a first surface 11 and a second surface 12 (shown here as a top surface 11 and a bottom surface 12) and includes a pair of substantially parallel side members 13 and a pair of substantially parallel end members 14. These end members 14 are substantially perpendicular to the side members 13 so as to form a generally rectangular structure. An internal structure having two cross members, a first cross member 15 and a second cross member 16, is integral with an disposed inside the rectangular structure. In particular, the first cross member 15 is disposed between and connected to both of the end members 14 and the second cross member 16 disposed between and connected to both of the side members 13.

As shown in more detail in FIGS. 2–6, the frame 10 has a substantially flat first surface 11 and a second surface 12 with a reinforcement structure projecting outwardly therefrom. In particular, the reinforcement structure of the side members 13, the end members 14 and the cross members 15,16 includes a plurality of longitudinal ribs 21 with a plurality of transverse ribs 22 disposed therebetween.

Figure 7:
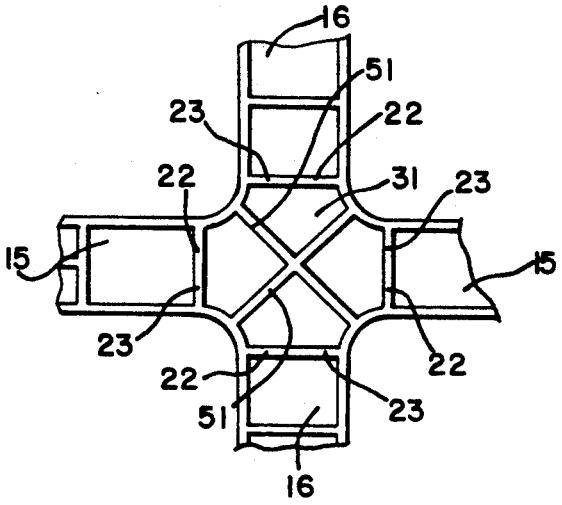
FIG. 7 is a bottom plan view of center reinforcement element.

In addition, interposed between the reinforcement structure of the first cross member 15 and the reinforcement structure of the second cross member 16, both of which include longitudinal ribs 21 and transverse ribs 22, is a generally X-shaped center reinforcement element 31. Shown in detail in FIG. 7, the center reinforcement element 31 has at each of the four ends an end rib 23 that is a common rib with one of reinforcing ribs of the cross members 15,16. In particular, each of the four end ribs 23 is a transverse rib 22 of one of the cross members 15,16. This center reinforcement element 31 further has an internal support structure that includes a pair of angled ribs 51 intersecting each other substantially in the middle and perpendicularly. As shown clearly in FIG. 2, each side of center reinforcement element 31 is inwardly rounded.

Figure 8:
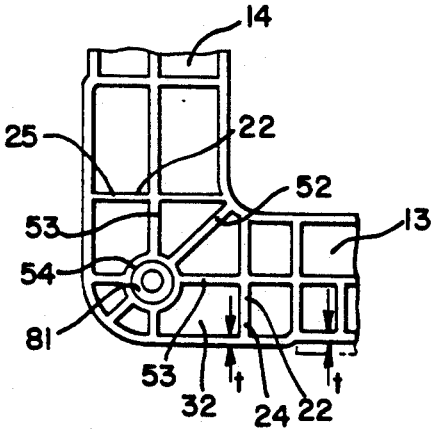
FIG. 8 is a bottom plan view of a corner reinforcement element.

Similarly, the reinforcement structure interposed between the reinforcement structures of each of the side members 13 and each of the end members 14 is a generally rectangular-shaped corner reinforcement element 32. Shown in detail in FIG. 8, each reinforcement corner element 32 includes two end ribs 24,25 that are common ribs with the reinforcement structures of either a side member 13 or of an end member 14. Specifically, at one side of the reinforcing corner element 32 there is a first end rib 24, that is a transverse rib 22 of a side member 13, and at an adjacent side, a second end rib 25, that is a transverse rib 22 of an end member 14. Each reinforcement corner element 32 also has an internal support structure that includes an angled rib 52 extending from the innermost point to the outermost point of this reinforcement element and a pair of first median ribs 53, each bisecting and being substantially perpendicular to an end rib 24,25.

Figure 6:
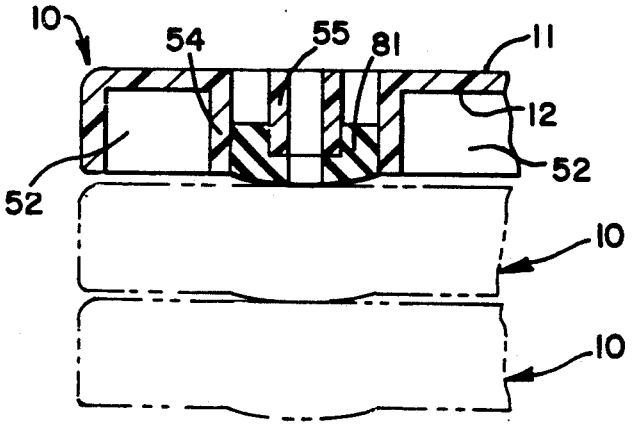
FIG. 6 is a cross-sectional view along line 6—6 of FIG. 2.

The angled rib 52 of the corner reinforcement element 32 further includes a supporting rib 54 integral therewith for supporting a pad 81 (shown in cross-section in FIG. 6). In the illustrated embodiment, the supporting rib is generally circular to hold a circular pad. This pad 81 is typically seated upon an internal support 55 and glued to both the internal support 55 and supporting rib 54. Preferably the pad extends below the supporting rib 54 so that when the frame 10 is placed on top of either another frame 10 (as in FIG. 6) or the rows of goods G, the pad, and not the frame 10, contacts the other frame or goods. Thus, when the pad is made of a soft material having a high coefficient of friction, it can prevent slipping and sliding of the frame 10 and reduce the possibility of the frame marring the surface, such as another frame or a row of goods, that the frame is resting on.

Preferably, to minimize safety concerns, to add strength and to reduce the amount of material, both the innermost and the outermost portions or corners of each of the corner reinforcement elements 32 are rounded.

Figure 9:
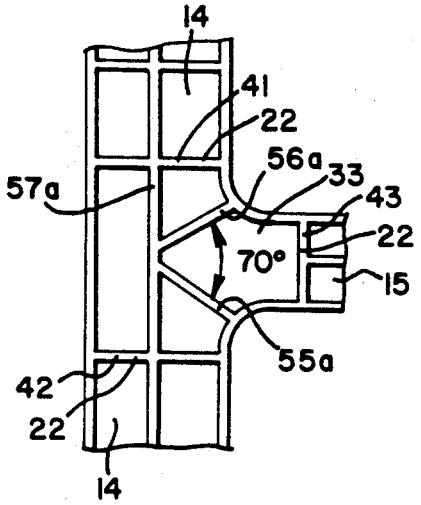
FIG. 9 is a bottom plan view of a first intermediate reinforcement element.

Additionally, the reinforcement structure interposed between the reinforcement structure of the first cross member 15 and the reinforcement structure of each of the two end members 14 is a generally T-shaped first intermediate reinforcement element 33. As shown in detail in FIG. 9, each first reinforcement intermediate element 33 includes three end ribs 41,42,43 that are common ribs with the reinforcement structures of either an end member 14 or of the first cross member 15. In particular, at the first end of the first intermediate reinforcement element 33, there is a first end rib 41, that is also a transverse rib 22 of the end member 14. At the second, opposite end there is located a second end rib 42, that is a separate transverse rib 22 of the same end member 14. Finally, there is at the third, intermediate end of this first intermediate reinforcement element 33, a third end rib 43 that is a transverse rib 22 of the first cross member 15.

The first intermediate reinforcement element 33 also has an internal support structure that includes internal angled ribs **55*a*,56*a*. These angled ribs 55*a*,56*a* are a pair of outwardly converging diagonal ribs that intersect a second median rib 57*a*. The second median rib 57*a* bisects and is substantially perpendicular to the first end rib 41 and the second end rib 42 of the first intermediate reinforcement element 33. As shown in further detail in FIG. 9, the angled ribs 55*a*,56*a* are integral with and begin from a point at or near the corners of the first intermediate reinforcement element 33 and extend to and are integral with the second median rib 57*a*. It has been found that for best results, the angle between the angled ribs 55*a*,56*a*** should be about 70 degrees and the angled ribs should not intersect one another.

As with the center reinforcement element 31 and with the corner reinforcement elements 32, the first intermediate reinforcement elements 33 have rounded corners.

Also, the reinforcement structure interposed between the reinforcement structure of the second cross member 16 and the reinforcement structure of each of the two side members 13 is a generally T-shaped second intermediate reinforcement element 34. As shown in detail in FIG. 10, each second intermediate reinforcement element 34 includes three end ribs 44,45,46 that are common ribs with the reinforcement structures of either a side member 13 or of the second cross member 16. Specifically, at the first end of the second intermediate reinforcement element S4 there is a first end rib 44, that is also a transverse rib 22 of the side member 13. At the second, opposite end there is a second end rib 45, that is a separate transverse rib 22 of the same side member 13. And finally, there is at the third, intermediate end of this second intermediate reinforcement element 34, a third end rib 46 that is a transverse rib 22 of the second cross member 16. In the preferred embodiment shown, the second intermediate reinforcement elements 34 have rounded corners like the first intermediate reinforcement elements 33.

Figure 10:
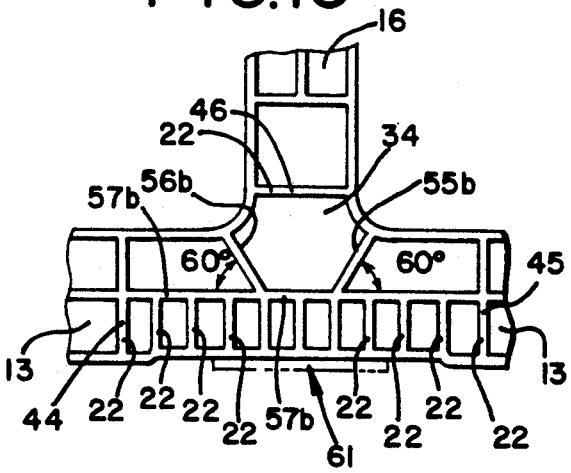
FIG. 10 is a bottom plan view of a second intermediate reinforcement element; and, FIG. 11 is a bottom plan view of a strap slot.

In much the same manner as the first intermediate reinforcement element 33, the second intermediate reinforcement element 34 also has an internal support structure that includes internal angled ribs **55*b*,56*b*. These angled ribs 55*b*,56*b* are also a pair of outwardly converging diagonal ribs that intersect a median rib 57*b*. This median rib 57*b* bisects and is substantially perpendicular to the first end rib 44 and the second end rib 45 of the second intermediate reinforcement element 34. As illustrated in FIG. 10, the angled ribs 55*b*,56*b* are integral with and begin from a point near the corners of the second intermediate reinforcement element 34 and extend to and are integral with the second median rib 57*b*. With respect to these second intermediate reinforcement elements 34, it has been found that for best results, the angle between each angled rib 55*b*,56*b* and the second median rib 57*b*** should be about 60 degrees and the angled ribs should not intersect one another.

The second intermediate reinforcement elements 34 have rounded corners like the first intermediate reinforcement elements 33.

Significantly, as shown in FIG. 1, the frame of the present invention is used in conjunction with a standard pallet P. The items, such as the goods G shown, to be either stored or moved are placed on the pallet P and the frame 10, often called a top frame in the industry, is placed over the items C. The entire assembly is bound and secured together. Straps S are typically used to bind the three components together. Consequently, to prevent the encircled straps from slipping and sliding and to minimize any problems that might result from the added thickness of the strap, i.e., rubbing against other frames, strap slots 61 are provided in the frame 10.

Figure 11:
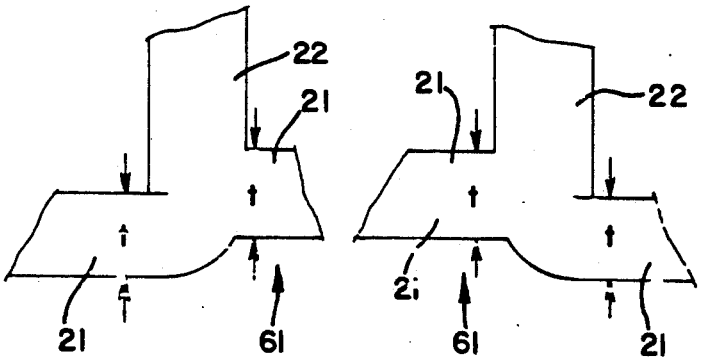

Because pallets are customarily designed and built to be rectangular, rather than square, the sides are of different length. In the example illustrated, the side members 13 are longer than the end members 14. The full dimension of a side member 13 in the A direction (shown in FIG. 1) is 44 inches and the full dimension of an end member 14 in the B direction (FIG. 1) is 56 inches. Consequently, there are preferably three strap slots 61 provided in the side member and two strap slots 61 provided in the end member. These strap slots 61 cause an off-set in the longitudinal rib 21 immediately adjacent each of the slots. Thus, there is formed an off-set portion in the longitudinal rib 21 immediately adjacent the strap slot 61. As detailed in FIG. 11, this off-set would be in the outermost longitudinal rib 21, which preferably has a constant thickness t (See also FIGS. 2 and 8). Moreover, additional transverse ribs 22 are positioned immediately adjacent and integral with each of these off-set portions of the longitudinal rib 21. Thus, as detailed in FIG. 2 and 10, for added strength there is a doubling of the density of the transverse ribs 22 immediately adjacent each side strap slot 61. Accordingly, there is provided a double density of transverse ribs 22 adjacent each of the corner reinforcement elements 32 along each side members 13, in two locations along each end member 14 and in each of the second intermediate reinforcement elements S4.

While the frame of the present invention has been described alone and in conjunction with a pallet, it is important to note that by the present design, it is easily transportable with other similar frames on return trips or during storage. Because the frame is relatively light and thin, it can be easily stacked (See FIG. 6). The strap slots 61 can be used to secure straps and encircle a column of such frames.

Also, the frame 10 is easily reversible. For example, in the illustrated example, the frame 10 is oriented on top of the palletized goods so that the first surface 11 faces upwards and the second surface 12 faces downwards. In some situations, such as when the goods are empty aluminum or steel cans, the frame is flipped over so that the first flat surface 11 faces downwards and the second surface 12 with ribs projecting therefrom faces upwards. Thus, the goods, with fragile edges, will contact a flat planar surface (surface 11), reducing the possibility of damaging an edge and, consequently, the cans. The strap slots 61 are used in the same manner as discussed previously.

The frame of the present invention is preferably made of plastic and injection molded from recycled material, such as polypropylene or similar thermoplastic material. A pigment may be added during the manufacturing process in order to produce a desired color or combination of colors.

In addition, the size and shape of can be varied without departing from the spirit of this invention. Similarly, the number of cross members employed and the actual shape of the frame may vary.

While a specific embodiment has been illustrated and described, numerous modifications come to mind without significantly departing from the spirit of the invention and the scope of protection is only limited by the scope of the accompanying claims.

We claim:

1. A unitary top frame device for use with palletized goods comprising:

a pair of substantially parallel side members;

a pair of substantially parallel end members that are substantially perpendicular to said side members and connected to said side members;

a first cross member disposed between said end members and connected to said end members;

a second cross member disposed between said side member disposed between said side members and connected to said side members;

a substantially flat first surface; and, a second surface with a reinforcement structure projecting outwardly therefrom, said reinforcement structure including a pair of substantially parallel, integral perimeter ribs along the perimeter of said side members, end members and cross members with a plurality of transverse ribs disposed therebetween.

2. A unitary top frame device for use with palletized goods comprising:

a pair of substantially parallel side members;

a pair of substantially parallel end members that are substantially perpendicular to said side members and connected to said side members;

a first cross member disposed between said end members and connected to said end members;

a second cross member disposed between said side member disposed between said side members and connected to said side members;

a substantially flat first surface; and, a second surface with a reinforcement structure projecting outwardly therefrom, said reinforcement structure of said side members, said end members and said cross members include a plurality of longitudinal ribs with a plurality of transverse ribs disposed therebetween, said reinforcement structure interposed between said reinforcement structure of said first cross member and said reinforcement structure of said second cross member is a generally X-shaped center reinforced element, said center reinforcement element having at each of the four ends an end rib being a transverse rib of a said cross member.

3. The unitary frame as defined in claim 2 wherein said reinforcement structure interposed between each said reinforcement structure of said side member and each said reinforcement structure of said end member is a generally rectangular-shaped corner reinforcement element, each said reinforcement corner element having at one side a first end rib being a transverse rib of said side member and at an adjacent side a second end rib being a transverse rib of said end member.

4. The unitary top frame as defined in claim 3 wherein said reinforcement structure interposed between said reinforcement structure of said first cross member and said reinforcement structure of each said end member is a generally T-shaped first intermediate reinforcement element, each said first reinforcement intermediate element having at the first end a first end rib being a transverse rib of one said end member, at the second, opposite end a second end rib being a separate transverse rib of said one end member and at the third, intermediate end a third end rib being a transverse rib of said first cross member.

5. The unitary frame as defined in claim 4 wherein said reinforcement structure interposed between said reinforcement structure of said second cross member and said reinforcement structure of each said side member is a generally T-shaped second intermediate reinforcement element, each said second intermediate reinforcement element having at the first end a first end rib being a transverse rib of one said side member, at the second, opposite end a second end rib being a separate transverse rib of said one side member and at the third, intermediate end a third end rib being a transverse rib of said second cross member.

6. The unitary frame as defined in claim 5 wherein said center reinforcement element has a pair of angled ribs substantially bisecting each other perpendicularly.

7. The unitary frame as defined in claim 6 wherein each said reinforcement corner element has an angled rib extending from the innermost point to the outermost point of said reinforcement corner element and a pair of median ribs, each said median rib bisecting and being substantially perpendicular to one said end ribs of said corner reinforcing element.

8. The unitary frame as defined in claim 5 wherein said first and second intermediate reinforcement elements include internal angled ribs.

9. The unitary frame as defined in claim 8 wherein said angled ribs of each said intermediate reinforcement element are a pair of outwardly converging diagonal ribs that intersect a median rib, said median rib bisecting and being substantially perpendicular to said first and said second end ribs of said intermediate reinforcement element.

10. The unitary frame as defined in claim 9 wherein each said side member and each said end member includes a strap slot for receiving a strap, said longitudinal rib having an off-set portion immediately adjacent said strap slot.

11. The unitary frame as defined in claim 10 wherein there is a double density of transverse ribs integral with said off-set portion of said longitudinal rib.

12. The unitary frame as defined in claim 11 wherein each said angled rib of said corner reinforcement elements includes a supporting rib integral therewith for supporting a pad.

13. The unitary frame as defined in claim 12 wherein said supporting rib is generally circular.

14. A unitary top frame device for use with palletized goods comprising:

(a) a pair of substantially parallel side members;

(b) a pair of substantially parallel end members that are substantially perpendicular to said side members and connected to said side members;

(c) a first cross member disposed between said end members and connected to said end members;

(d) a second cross member disposed between said side members and connected to said side members;

(e) a substantially flat first surface; and, (f) a second surface with a reinforcement structure projecting outwardly therefrom, (i) said reinforcement structure of said side members, said end members and said cross members includes a plurality of longitudinal ribs with a plurality of transverse ribs disposed therebetween, (ii) said reinforcement structure interposed between said reinforcement structure of said first cross member and said reinforcement structure of said second cross member being a generally X-shaped center reinforcement element, said center reinforcement element having a pair of angled ribs intersecting each other substantially in the middle and perpendicularly and at each of the four ends an end rib being a transverse rib of a said cross member, (iii) said reinforcement structure interposed between said reinforcement structure of each said side member and said reinforcement structure of each said end member being a generally rectangular-shaped corner reinforcement element, each said reinforcement corner element having at one side a first end rib being a transverse rib of said side member, at an adjacent side a second end rib being a transverse rib of said end member, an angled rib extending from the innermost point to the outermost point of said reinforcement corner element and a pair of median ribs, each said median rib bisecting and being substantially perpendicular to one said end ribs of said corner element, (iv) said reinforcement structure interposed between said reinforcement structure of said first cross member and each said reinforcement structure of said end member being a generally T-shaped first intermediate reinforcement element, each said first reinforcement intermediate element having at the first end a first end rib being a transverse rib of one said end member, at the second, opposite end a second end rib being a separate transverse rib of said one end member and at the third, intermediate end a third end rib being a transverse rib of said first cross member, (v) each said reinforcement structure interposed between said reinforcement structure of said second cross member and said reinforcement structure of said each side member being a generally T-shaped second intermediate reinforcement element, each said second intermediate reinforcement element having at the first end a first end rib being a transverse rib of one said side member, at the second, opposite end a second end rib being a separate transverse rib of said one side member and at the third, intermediate end a third end rib being a transverse rib of said second cross member.

15. A unitary top frame device for use with palletized goods comprising:

(a) a pair of substantially parallel side members;

(b) a pair of substantially parallel end members that are substantially perpendicular to said side members and connected to said side members;

(c) a first cross member disposed between said end members and connected to said end members;

(d) a second cross member disposed between said side members and connected to said side members;

(e) a substantially flat first surface; and, (f) a second surface with a reinforcement structure projecting outwardly therefrom, (i) said reinforcement structure of said side members, said end members and said cross members includes a plurality of longitudinal ribs with a plurality of transverse ribs disposed therebetween, (ii) said reinforcement structure interposed between said reinforcement structure of said first cross member and said reinforcement structure of said second cross member being a generally X-shaped center reinforcement element, said center reinforcement element having a pair of angled ribs intersecting each other substantially in the middle and perpendicularly and at each of the four ends an end rib being a transverse rib of a said cross member, (iii) said reinforcement structure interposed between said reinforcement structure of each said side member and said reinforcement structure of each said end member being a generally rectangular-shaped corner reinforcement element, each said reinforcement corner element having at one side a first end rib being a transverse rib of said side member, at an adjacent side a second end rib being a transverse rib of said end member, an angled rib extending from the innermost point to the outermost point of said reinforcement corner element and a pair of median ribs, each said median rib bisecting and being substantially perpendicular to one said end ribs of said corner element, each said angled rib of said corner reinforcement element including a supporting rib integral therewith for supporting a pad, (iv) said reinforcement structure interposed between said reinforcement structure of said first cross member and each said reinforcement structure of said end member being a generally T-shaped first intermediate reinforcement element, each said first reinforcement intermediate element having at the first end a first end rib being a transverse rib of one said end member, at the second, opposite end a second end rib being a separate transverse rib of said one end member and at the third, intermediate end a third end rib being a transverse rib of said first cross member, (v) each said reinforcement structure interposed between said reinforcement structure of said second cross member and said reinforcement structure of said each side member being a generally T-shaped second intermediate reinforcement element, each said second intermediate reinforcement element having at the first end rib being a transverse rib of one said side member, at the second, opposite end a second end rib being a separate transverse rib of said one side member and at the third, intermediate end a third end rib being a transverse rib of said second cross member.

16. The unitary frame as defined in claim 15 wherein each said first and each said second intermediate reinforcement elements include internal angled ribs, said angled ribs being a pair of outwardly converging diagonal ribs that intersect a median rib, said median rib bisecting and being substantially perpendicular to said first and said second end ribs of said intermediate reinforcement element.

17. The unitary frame as defined in claim 16 wherein each said side member and each said end member includes a strap slot for receiving a strap, said strap slot being formed by the offsetting of a portion of the outermost longitudinal rib of each said member.

18. The unitary frame as defined in claim 17 wherein there is a double density of transverse ribs integral with said off-set portion of said longitudinal rib.

19. A unitary top frame for use with palletized goods comprising:

(a) a rectangular perimeter support structure including (i) a pair of substantially parallel side members; and, (ii) a pair of substantially parallel end members integral and perpendicular to said side members; and, (b) an internal support structure including (i) a first cross member integral and perpendicular to said end members and (ii) a second cross members integral and perpendicular to said side members;

(A) said cross members substantially bisecting each other; and, (c) a planar member integral with said perimeter support structure and said internal support structure, said planar member having a pair of substantially parallel, integral perimeter ribs along the perimeter of said perimeter support structure and said internal support structure and having a plurality of transverse ribs disposed between said perimeter ribs.

20. A unitary top frame for use with palletized goods comprising:

(a) a rectangular perimeter support structure including (i) a pair of substantially parallel side members, and, (ii) a pair of substantially parallel end members integral and perpendicular to said side members, (A) each said side member and each said end member is interconnected by a generally rectangular-shaped corner element, (1) each said corner element having at one side a first end rib being a transverse rib of said side member and at an adjacent side a second end rib being a transverse rib of said end member;

(b) an internal support structure including (i) a first cross member integral and perpendicular to said end members; and, (ii) a second cross member integral and perpendicular to said side members, (A) said cross members substantially bisecting each other (1) said first cross member and said second cross member are interconnected by a generally X-shaped center element, (a) said center element having at each of the four ends an end rib being a transverse rib of a said cross member, (2) said first cross member and each said end member are interconnected by a generally T-shaped first intermediate element, each said first intermediate element having at the first end a first end rib being a transverse rib of one said end member, at the second, opposite end a second end rib being a separate transverse rib of said one end member and at the third, intermediate end a third end rib being a transverse rib of said first cross member, (3) said second cross member and each said side member interconnected by a generally T-shaped second intermediate element, each said second intermediate element having at the first end a first end rib being a transverse rib of one said side member, at the second, opposite end a second end rib being a separate transverse rib of said one side member and at the third, intermediate end a third end rib being a transverse rib of said second cross member, each said end member, each said side member and each said cross member has a plurality of longitudinal ribs interconnected to a plurality of transverse ribs; and (c) a planar member integral with said perimeter support structure and said internal support structure.

21. The unitary frame as defined in claim 20 wherein said center element has a pair of angled ribs bisecting each other perpendicularly, each said corner element has an angled rib extending from the innermost point to the outermost point of said element, and a pair of median ribs, each said median rib bisecting and being substantially perpendicular to one said end rib of said corner element.

22. The unitary frame as defined in claim 21 wherein each said first and each said second intermediate element includes internal angled ribs that are a pair of outwardly converging diagonal ribs that intersect a median rib, said median rib bisecting and being substantially perpendicular to said first and said second end ribs of said intermediate element.

23. The unitary frame as defined in claim 22 wherein each said side member and each said end member includes a strap slot for receiving a strap, said longitudinal rib having an off-set portion immediately adjacent said strap slot.

24. The unitary frame as defined in claim 23 wherein there is a double density of transverse ribs integral with said off-set portion of said longitudinal rib.

25. A unitary top frame device for use with palletized goods comprising:

a pair of side members;

a pair of end members that intersect and are connected to said side members;

a first cross member disposed between said end members and connected to said end members;

a second cross member disposed between said side members and connected to said side members;

a substantially flat first surface; and, a second surface with a reinforcement structure projecting outwardly therefrom, said reinforcement structure including a pair of substantially parallel, integral perimeter ribs along the perimeter of said side members, end members and cross members with a plurality of transverse ribs disposed therebetween.

* * * * *